United States Patent [19]

Kirkpatrick

[11] 4,161,269

[45] Jul. 17, 1979

[54] WEB CLAMP

[75] Inventor: Alan D. Kirkpatrick, Sparta, N.J.

[73] Assignee: Corrugated Development, Inc., Fairfield, N.J.

[21] Appl. No.: 853,240

[22] Filed: Nov. 21, 1977

[51] Int. Cl.[2] ..... B65H 29/04

[52] U.S. Cl. ..... 226/92; 271/204

[58] Field of Search ..... 226/91, 92; 271/204, 271/205, 206

[56] References Cited

U.S. PATENT DOCUMENTS

| | | | |
|---|---|---|---|
| 3,148,878 | 9/1964 | Eichorn | 271/204 |
| 3,809,390 | 5/1974 | Lenoir | 271/204 |
| 3,948,508 | 4/1976 | Kanazawa | 271/206 |

FOREIGN PATENT DOCUMENTS

| | | | |
|---|---|---|---|
| 552330 | 5/1932 | Fed. Rep. of Germany | 271/205 |

*Primary Examiner*—Richard A. Schacher

*Attorney, Agent, or Firm*—Carella, Bain, Gilfillan & Rhodes

[57] ABSTRACT

A clamp for carrying the leading edge of a web of material is disclosed to include a base bar and at least one clamping element, the clamping element being pivoted on the base bar between clamping and loading positions and being maintained in such positions by an overcenter spring means, and further including camming means for positively displacing the clamping means between clamping and a release position against the bias of said spring.

10 Claims, 8 Drawing Figures

WEB CLAMP

BACKGROUND OF THE INVENTION

This invention relates generally to the field of web feed devices. More specifically, this invention relates to a clamping means for advancing the leading edge of a web of material into position for being fed into a production line.

The clamping means of the present invention is particularly useful with a splicer apparatus for connecting the leading end of a web of material to be fed into a production line to the trailing end of a web of material already having been fed into the production line without the necessity for stopping the advancement of material into the production line. Such apparatus is disclosed and claimed in my co-pending application, Ser. No. 871,557, filed Jan. 23, 1978 and entitled WEB HANDLING APPARATUS.

There are many manufacturing operations wherein most efficient utilization of raw materials and equipment requires the manufacturing operation to be conducted on a continuously moving web. Because there is no such thing as an endless supply of raw material, particularly rolled material such as paper, cardboard, craft, floor coverings and the like, it has been a source of continuing concern to those skilled in these arts as to the best manner in which to connect the trailing edge of one roll of material being utilized in a production process with the leading edge of a next subsequent roll of material to be utilized in the manufacturing process.

In all apparatus for performing splices the leading edge of a web to be fed must properly be positioned. Often this has been accomplished manually. Less often the industry has utilized a clamping device to connect to and advance a web however prior art clamping devices have been complex, expensive and often damaging to the web material being fed.

SUMMARY OF THE INVENTION

It is an object of the present invention, therefore, to provide a clamp means for web material which clamp means releasably grips the web material for advancement into a production line apparatus.

An additional object of the present invention is to provide a clamp means for web material wherein forces tending to withdraw the web of material from the clamp means cause the clamp means to clamp even with greater force against the web of material.

Still a further object of the present invention is to provide a clamp means for web material wherein the clamping element of the clamp means is displaceable out of clamping position to fully expose the web edge.

Yet another object of the present invention is to provide a clamp means for web material which is simple in construction, economical to manufacture and which requires a minimum of maintenance.

It is yet another object of the present invention to provide a clamp means for a web of material wherein initial clamping of the web material is achieved by spring operation and means are provided for positive displacement of the clamping means away from the web material to achieve selective release against the bias of the spring.

These objects and other not enumerated are achieved by the web clamp of the present invention one embodiment of which may include a base bar and at least one clamping element, the clamping element being pivoted on the base bar between clamping and loading positions and being maintained in such positions by an over-center spring means, the clamp further including a camming means for positively displacing the clamping means between clamping and a release position against the bias of the spring.

BRIEF DESCRIPTION OF THE DRAWINGS

A more complete understanding of the present invention may be had from the following detailed description thereof, particularly when read in the light of the accompanying drawings wherein.

DETAILED DESCRIPTION

Figure 1:
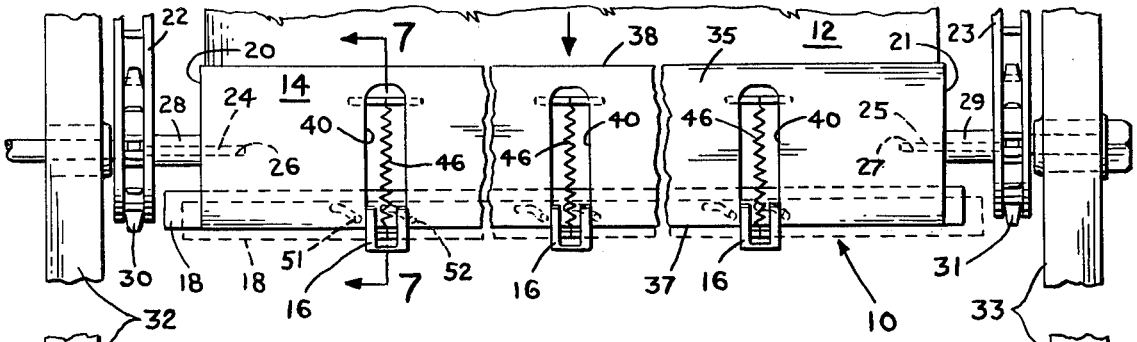
FIG. 1 is a plan view of web clamp according to the invention.

As stated above, this invention relates to clamping apparatus for engaging a web of material, imparting tensile force to the web of material to achieve movement or otherwise, and for selectively disengaging from the web. Such a web clamp structured in accordance with the teaching of the present invention is shown in FIGS. 1 and 2 and designated generally by reference numeral 10.

Figure 2:
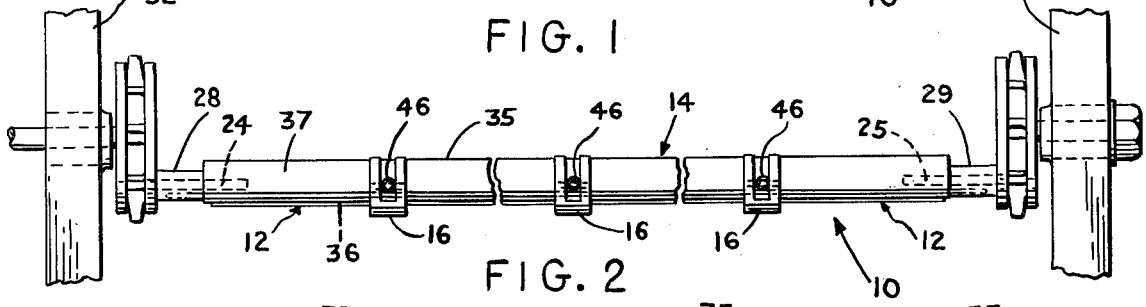
FIG. 2 is a front elevational view of the web clamp according to the invention.
Figure 3:
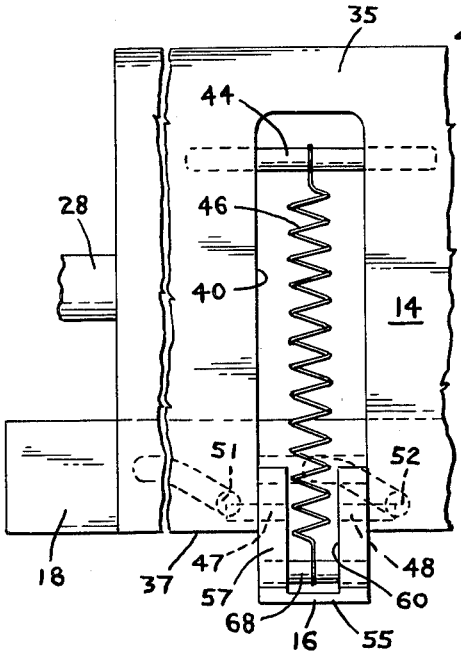
FIG. 3 is a detailed plan view of a clamping element according to the invention.
Figure 4:
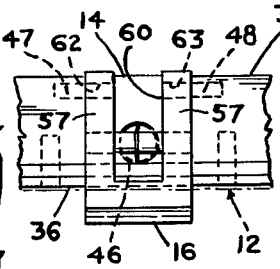
FIG. 4 is a front elevational view of the structure shown in FIG. 3.
Figure 5:
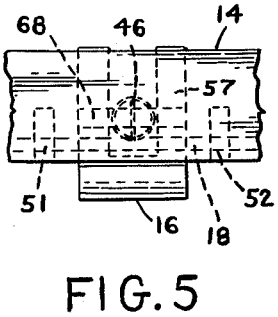
FIG. 5 is a rear elevational view of the structure shown in FIG. 3.
Figure 6:
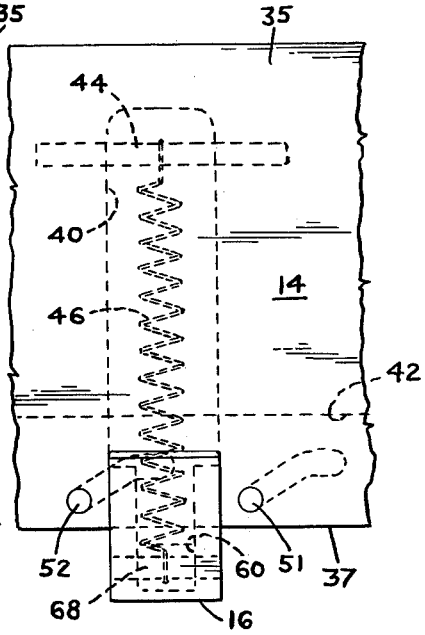
FIG. 6 is a bottom view of the structure shown in FIG. 3.

More specifically, there is shown in FIGS. 1 and 2 a web clamp 10, according to the invention, which is clamping a web 12 and advancing the web in the direction of the arrow shown in FIG. 1. Broadly speaking, web clamp 10 comprises a base bar 14, a plurality of pivoted clamping elements 16 and a camming bar 18.

Base bar 14 is secured at its opposed ends 20, 21 to a pair of chains 22, 23 by a pair of connecting pins 24, 25. Connecting pins 24, 25 comprise elongated machine screws which are sized to pass through and act as the pivots in the respective links of chains 22, 23 and are threadedly received in tapped bores 26, 27 formed in the ends 20, 21, respectively, of base bar 14. Threads are provided on pins 24, 25 only by the length which substantially corresponds to the depth of bores 26, 27. The remaining surface of pins 24, 25, with the exception of their heads, is smooth to accommodate the sliding contact with the chain links and also to provide for the mounting of spacer sleeves 28 and 29 (FIG. 2). Spacer sleeves 28 and 29 are generally cylindrical elements which maintain chains 22 and 23 at a pre-selected distance from the ends 20, 21 of base bar 14.

Chains 22 and 23 operatively engage sprocket wheels 30 and 31 respectively, which wheels are rotatably mounted in support structure 32, 33. Chains 22 and 23 are also operatively engaged with other sprocket wheels (not shown) at least one of which is provided with a drive means for rotating its related sprocket wheel, driving chains 22 and 23 and therewith web clamp assembly 10. Such driving occurs for the purpose of advancing a web such as web 12 and also for repositioning web clamp 10 to be properly positioned for clamping a new web end as is discussed below.

As best may be seen in FIGS. 1 and 2, the preferred embodiment of web clamp 10 shown is provided with three clamping elements 16. It will be recognized, however, that the number of clamping elements is not critical and more or fewer can be utilized as may be determined by the needs of any particular use of the clamp.

Base bar 14 is an elongated element which is generally rectangular in cross-sectional configuration. With reference to FIGS. 1 and 2, base bar 14 can be seen to have an upper surface 35, a lower surface 36, a forward surface 37 and a rearward surface 38. At each transverse position where it is desired to locate a clamping element the upper surface 35 of base bar 14 is relieved to define a channel 40 which extends from forward surface 37 through a major portion of the width of bar 14 and from upper surface 35 through a major portion of the depth of base bar 14 (see FIG. 7). Also formed in the forward surface 37 of base bar 14 is a slot 42 which extends across the entire length of base bar 14, i.e. from end 20 to end 21. Slot 42 is sufficiently high and deep to accommodate the slidable mounting therein of camming bar 18.

Figure 7:
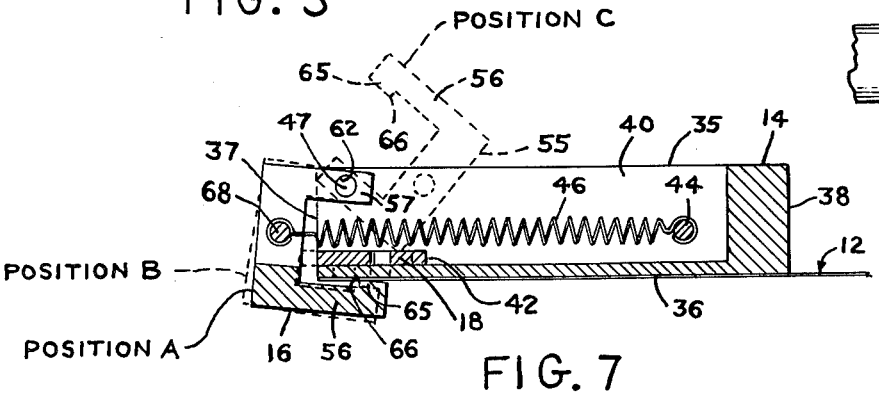
FIG. 7 is a cross-sectional view of the plan 77 shown in FIG. 1.
Figure 8:
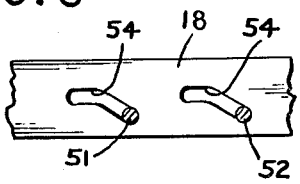
FIG. 8 is a partial view showing the cooperation of the camming bar and camming structure of the base bar in the clamp according to the present invention.

Rigidly mounted to extend across one end of channel 40 is a pin 44 which, as is discussed below, defines an anchor point to which one end of a spring 46 may be secured. Rigidly mounted in the other end of channel 40 adjacent but slightly displaced from upper surface 35 are a pair of pivot pins 47, 48. Pins 47 and 48 extend outwardly from the walls of channel 40 to define pivot support means for clamping element 16 but only so far as to permit passage therebetween of spring 46 as clamping element 16 moves from operational position to retracted position (FIG. 7).

Also rigidly mounted in base bar 14 are pairs of vertically disposed pins 51 and 52 which are spaced from but adjacent to the sides of channel 40. Pins 51 and 52 are positioned to extend across slot 42 and to cooperate with camming slots 55 formed in camming bar 18 as is discussed below in detail.

Each clamping element 16 is a generally U-shaped member having a base 55, a first arm 56 and a second arm comprising a pair of spaced elements 57. First arm 56 and spaced elements 57 extend normally to the plane of base 55. The second arm and a portion of base 55 of clamping element 16 are relieved to define a channel 60 to permit rotating movement of clamping element 16 without interference from spring 46.

Formed through elements 57 are aligned coaxial throughbores 62, 63 which are sized to slidably receive pivot pins 47, 48 respectively therein. Thus pivot pins 47, 48 cooperate with throughbores 62, 63 to define pivot means around which clamping elements 16 rotate with respect to base bar 14. Formed on the upper end of first arm 56 of clamping element 16 is an inwardly extending shoulder 65 having an inner transversely extending edge 66. Shoulder 65 through edge 66 defines the web gripping edge of clamp 10 and is dimensioned such that upon maximum counter-clockwise rotation as seen in FIG. 7, inner edge 66 always makes edge contact with either a web 12 being clamped or the lower surface 36 of base bar 14. The angular relationship thus established insures that any tension placed on web 12 tending to withdraw the web from the clamp will cause the edge 66 to grip the web material more forcefully by tending to cause further rotation of clamping element 16 around pivot pins 47, 48 in the counter-clockwise direction.

Rigidly secured to base 55 of clamping element 16 and extending across the channel 60 formed therein is a pin 68. Pin 68 accommodates the attachment thereto of one end of spring 46, the other end of the spring being attached to base bar 14 through pin 44 as is discussed above. Because pin 68 rotates with clamping element 16 about the axis of pins 47, 48, spring 46 cooperates therewith to provide over-center spring effect which urges edge 66 of shoulder 65 against web 12 in the counter-clockwise direction and which urges clamping element 16 fully clear of the forward surface 37 of base bar 14 in the clockwise direction.

As is clear from FIGS. 1 and 2, camming bar 18 is an elongated bar which is slidably received within slot 42 of base bar 14. At each location of a clamping element 16 camming bar 18 is provided with a pair of cam slots 54 through which are slidably received camming pins 51 and 52.

As best may be seen in FIG. 7, clamping element 16 has three basic positions, viz. that shown in solid line (POSITION A) which is the gripping position, that shown in broken line (POSITION B) which is the release position, i.e. slightly arcuately displaced from the gripping position, and that shown in broken line (POSITION C) which is the retracted position. Camming bar 18 is utilized in conjunction with the force of spring 46 to displace clamping element 16 between gripping and release positions. Thus with the camming bar 18 in the position shown in solid line in FIGS. 1 and 7, clamping elements 16 are in the gripping position. As the camming bar is displaced to the right as seen in FIG. 1, e.g. by an air motor (not shown) or manually, the camming bar moves out of slot 42 into the position shown in broken lines in FIGS. 1 and 7. The displacement of camming bar 18 out of slot 42 is such as to cause its engagement with the surface of base 55 of the clamping element to cause rotational displacement of the clamping element from the clamping position (POSITION A) as seen in FIG. 7 to the release position (POSITION B) as seen in FIG. 7. With the clamping element so positioned the web 12 is released from the clamp and the clamp may be displaced to a position to clamp a fresh web.

As is also evident from FIG. 7, clamping element 16 may be pivoted in the counter-clockwise direction to a loading position (POSITION C). In this loading position the force line of spring 46 has passed beyond the axis of pivots 47 and 48 thus resulting in an over-center effect thereby resulting in spring 46 urging clamping element 16 in a counter-clockwise direction and into the loading position.

During operation of clamp 10 the clamping element 16 is rotated manually into loading position (POSITION C) and a web 12 is positioned along surface 36 of base bar 14. Although the orientation is not shown in the drawing, the loading operation is ordinarily done with surface 36 facing upwardly such that the web 12 may be laid upon the clamp. With the web positioned on surface 36 a knife may be drawn along the edge of base bar 14 at the intersection of surfaces 36 and 37 to align the leading edge of the web with the base bar. Thereafter the clamping element 16 may be rotated manually to clamping position (POSITION A) thereby to firmly clamp the web 12. The clamp 10 may then be displaced as desired to cause displacement of the web to some desired position, e.g. to a feed position in a web feeding mechanism. Upon reaching the desired position camming bar 18 is displaced within slot 42 to rotate the camming element 16 from clamping to position (POSITION A) to release position (POSITION B) as seen in FIG. 7. The web 12 is then released and the clamp 10 may be relocated to clamp a new web.

The clamp according to the present invention may be manufactured from commercially available materials e.g. steel, using the known manufacturing techniques. It will also be recognized by those having ordinary skill in these arts that although a preferred embodiment of the invention has been disclosed and described in detail, many modifications and variations to the design may be made without departing from the spirit and scope of the invention.

I claim:

1. A clamp for carrying the edge of a web of material comprising:

a base bar;

at least one clamping element pivotally secured to said base bar said at least one clamping element being pivotable between clamping, release and loading positions;

spring means connected to said base bar and said clamping element, said spring means for urging said clamping element into said clamping position and also for urging said clamping element into said loading position; and camming means slidably engaging said at least one clamping element, said camming means for displacing said at least one clamping element from said clamping position to said release position against the force of said spring means.

2. Clamp structure according to claim 1 wherein said spring means is located with respect to said base bar and said clamping element to define an over-center spring, said spring means urging said clamping element toward said clamping position in one direction of rotation, and toward said loading position in the opposite direction of rotation.

3. Clamp structure according to claim 1 wherein said at least one clamping element comprises a U-shaped member having a base and first and second elements extending normally to said base and wherein said first normally extending element includes a shoulder means defining a clamping edge.

4. Clamp structure according to claim 3 wherein the degree of rotation of said clamping element into clamping position is limited by engagement of said clamping edge with said base bar and wherein the angle of engagement of said clamping edge with a web being clamped is such as to cause a tendency to increase clamping force in response to attempts to withdrawal of said web from said clamp structure.

5. A clamp for carrying the edge of a web of material comprising:

a base bar;

at least one clamping element pivotally secured to said base bar, said at least one clamping element being pivotable between clamping, release and loading positions;

spring means connected to said base bar and said clamping element, said spring means for urging said clamping element into said clamping position;

camming means slidably engaging said at least one clamping element, said camming means for displacing said at least one clamping element from said clamping position to said release position against the force of said spring means; and a slot formed in said base bar and a pair of pins secured in said base bar and extending across said slot, wherein said camming means comprises a camming bar element slidably disposed within said slot, said camming bar element including a pair of camming slots formed therein for receiving said pin therethrough, said pins for cooperating with said camming slots to cause displacement of said camming bar in one direction in response to displacement of said bar in a second direction.

6. A clamp for carrying the edge of a web of material comprising:

a base bar;

at least one clamping element pivotally secured to said base bar, said at least one clamping element being pivotable between clamping, release and loading positions, and comprising a U-shaped member having a base and first and second elements extending normally to said base, said first normally extending element including a shoulder means defining a clamping edge and wherein said second normally extending element and a portion of said base are relieved to define a channel, said channel for accommodating pass through of said spring during over-center operation of said clamping element;

spring means connected to said base bar and said clamping elements, said spring means for urging said clamping element into said clamping position; and camming means slidably engaging said at least one clamping element, said camming means for displacing said at least one clamping element from said clamping position to said release position against the force of said spring means.

7. Clamp structure according to claim 6 wherein said relief of said second normally extending element defines a pair of normally extending arms, each of said arms having a bore formed therein, each said bore for accommodating pins mounted on said base bar to define the pivotal connection for said clamping element.

8. Clamp structure according to claim 6 including a pin rigidly mounted in said base of said clamping element and extending across said channel formed therein and wherein said spring means is secured at one end to said pin in said base of said clamping element.

9. Clamp structure according to claim 8 wherein said spring means is located with respect to said base bar and said clamping element to define an over-center spring, said spring means urging said clamping element toward said clamping position in one direction of rotation, and toward said loading position in the opposite direction of rotation.

10. A clamp for carrying the edge of a web of material comprising:

a base bar, said base bar comprising an elongated member having upper, lower, forward and rearward surfaces as well as end surfaces, said forward surface of said base bar being relieved to define a slot therein;

at least one clamping element pivotally mounted on said base bar, said clamping element comprising a generally U-shaped member and being rotatable between clamping release and loading positions;

spring means connected to said base bar and said clamping element for urging said clamping element into said clamping position in one direction of rotation and into said loading position in the opposite direction of rotation; and camming means slidably disposed within said slot in said base bar, said camming means being displaceable in and out of said slot in response to movement of said camming means within said slot from one end of said base bar to said other end of said base bar, said camming means for displacing said clamping element from clamping to release position against the force of said spring.

* * * * *